US005592701A

United States Patent [19]

Smith

[11] Patent Number: 5,592,701

[45] Date of Patent: Jan. 14, 1997

[54] SINK STOPPER

[76] Inventor: Ronald A. Smith, 35 Cranston Drive, Caledon East Ontario, Canada, L0N 1E0

[21] Appl. No.: 612,186

[22] Filed: Mar. 7, 1996

[51] Int. Cl.[6] ..... A47K 1/14

[52] U.S. Cl. ..... 4/295; 4/287; 4/292

[58] Field of Search ..... 4/286, 287, 288, 4/290, 291, 292, 293, 295, DIG. 14

[56] References Cited

U.S. PATENT DOCUMENTS

| | | | |
|---|---|---|---|
| 1,753,631 | 4/1930 | Walters | 4/295 |
| 3,027,569 | 4/1962 | Lantz et al. | 4/295 |
| 3,525,105 | 8/1970 | Richards | 4/287 |
| 3,609,776 | 10/1971 | Haldopoulos et al. | 4/295 |
| 4,160,293 | 7/1979 | Niemann . | |
| 4,232,407 | 11/1980 | Williams . | |

FOREIGN PATENT DOCUMENTS

| | | | |
|---|---|---|---|
| 1130510 | 8/1982 | Canada | A47K 1/14 |
| 1197653 | 12/1985 | Canada | E03C 1/262 |
| 642311 | 7/1962 | Italy | 4/286 |
| 758098 | 9/1956 | United Kingdom . | |
| 1001532 | 8/1965 | United Kingdom | 4/295 |
| 1031993 | 6/1966 | United Kingdom | A47K 1/14 |
| 2067398 | 7/1981 | United Kingdom | A47K 1/14 |

*Primary Examiner*—David J. Walczak
*Assistant Examiner*—Charles R. Eloshway
*Attorney, Agent, or Firm*—Donald E. Hewson

[57] ABSTRACT

A sink stopper comprises a perforated strainer basket, a sealing member, an upwardly extending handle, and a downwardly depending locating stem. The locating stem comprises a base portion and two substantially parallel spaced-apart co-operating legs that are substantially rigid yet resiliently deformable towards each other. Each peripheral surface comprises an outwardly and upwardly sloped guide surface disposed at the bottom end portion thereof, an outwardly and downwardly sloped grate-contacting surface disposed at the top end portion thereof, and a grate-receiving notch disposed between the guide surface and the grate-contacting surface. The grate-receiving notch includes an upwardly facing catch surface shaped and dimensioned to catch on the grate in interfering relation therewith. The maximum width of the locating stem at the bottom end of the sloped grate-contacting surface is greater than the diameter of the central guiding aperture in the grate. The sink stopper is movable between a seated flow precluding position whereat the locating stem engages the grate at the outwardly and downwardly sloped grate-contacting surface so as to thereby bias the sink stopper downwardly, and a raised straining position whereat the locating stem engages the grate at the grate-receiving notch, so as to thereby support the sink stopper and so as to resist upward movement therefrom of the sink stopper.

7 Claims, 4 Drawing Sheets

SINK STOPPER

FIELD OF THE INVENTION

This invention relates to sink stoppers for use with an insert assembly in a sink, and more particularly to sink stoppers having a seated flow precluding position and a raised straining position, within the insert assembly.

BACKGROUND OF THE INVENTION

When using a kitchen sink, such as during the washing of dishes, it is common to use a sink stopper to plug the drain, thus precluding water and debris from draining from the sink and flowing down into the drain. Such sink stoppers typically comprise a circular strainer basket that generally covers the opening of the drain, with a plurality of drainage apertures disposed in the strainer basket. The drainage apertures are shaped and dimensioned to permit the flow of water therethrough, but to preclude the passage of most debris. An annular rubber seal is disposed underneath the strainer basket of the sink stopper and is shaped to engage the mouth of the insert assembly of the drain, so as to provide a seal between the sink stopper and the insert assembly.

Sink stoppers also include a centrally disposed locating stem depending from the strainer basket. The stem is used to guide the sink stopper into a central guiding aperture in a perforated portion of the insert assembly of the drain.

The main function of a sink stopper is to cover the opening of the drain of a sink when the sink stopper is seated on the insert assembly, thus precluding water and debris from flowing down into the drain. The secondary function of a sink stopper is that of a strainer, wherein water is permitted to flow down into the drain, while most of the debris in the water, specifically the relatively large size debris such as pieces of food, is precluded from flowing down into the drain. Accordingly, sink stoppers typically have two distinct in-use positions at the mouth of the insert assembly of the drain, namely a seated flow precluding position and a raised straining position. In the seated flow precluding position, the sink stopper is disposed at the mouth of the insert assembly such that the annular rubber seal engages the mouth of the insert assembly so as to provide a seal between the sink stopper and the insert assembly. In the raised straining position, the sink stopper is disposed slightly above its seated flow precluding position, preferably only a slight distance above the insert assembly, such that only a small radial clearance exists between the periphery of the sink stopper and the surrounding wall of the insert assembly. The small radial clearance must be small enough to preclude the passage of debris contained within the water within the sink from passing between the sink stopper and the mouth of the insert assembly.

It is desirable that the sink stopper be manually movable downwardly from its raised straining position to its seated flow precluding position, by means of an easy and simple downwardly directed pushing effort, so that the sink stopper can be pushed to its seated flow precluding position quickly, if necessary, to stop water and small debris from flowing down the drain. It is also desirable that the sink stopper be manually moveable upwardly from its seated flow precluding position to its raised straining position by means of a relatively easy and simple effort, since the sink stopper must be raised against the downwardly directed force of the weight of the water in the sink.

Once the sink stopper has been situated in its raised straining position, the sink stopper must remain readily in its raised straining position of its own accord, without being held there by auxiliary means such as a person's fingers. Further, it should be possible to remove the sink stopper from the insert assembly so as to permit direct access to the insert assembly, to permit replacement of the sink stopper, and so on. Such lifting of the sink stopper from its raised straining position and subsequent removal from the insert assembly, should be somewhat difficult, but not overly difficult, so as to discourage the unnecessary removal of the sink stopper, thus minimizing possible misplacement of the sink stopper when not in use.

DESCRIPTION OF THE PRIOR ART

There are various prior art sink stoppers that are configured so as to, when in use, have a raised straining position and a seated flow precluding position; however, none of these prior art sink stopper is readily removable from the insert assembly of the sink.

United Kingdom patent No. 2,067,398A discloses a sink stopper with a plug member mounted on a two leg stem. The two legs of the stem extend downwardly from the plug member, one on either side of a first diametrical plane. The two legs are separated one from the other on opposite sides of a second diametrical plane transverse to the first diametrical plane, and diverge one from the other from their top ends to their bottom ends. The legs are resiliently deformable towards one another, in a scissor-like action, thus allowing the overall width of the stem at bottom portion thereof to be selectively decreased, temporarily, when pinched toward each other. Each of the two legs has a sloped face disposed at its respective outer edge near the bottom end, which sloped faces converge downwardly, one with respect to the other. Accordingly, insertion of the stem through a small diameter central guiding aperture in the grate of the insert assembly of a sink, causes the sloped faces of the legs to engage the edges of the central guiding aperture, so as to thereby cause the two legs to be pinched together until a decreased maximum width of the stem is essentially the same as the width of the central guiding aperture, thus permitting the stem to be fully inserted into the central guiding aperture. After passing through the central guiding aperture, the two legs return to their wider original position.

Positioned immediately above each of the two sloped faces is a substantially horizontally disposed upwardly facing shoulder. When the stem is fully inserted into the grate of the insert assembly, the upwardly facing shoulders abut against the bottom surface of the horizontally disposed grate, so as to preclude the stem from subsequently being lifted back through the central guiding aperture in the horizontally disposed grate. In order to allow the stem to be lifted back through the central guiding aperture in the grate, the two legs must be pressed toward each other in a direction along the first diametrical plane, until the maximum width of the stem is no greater than the size of the central guiding aperture in the horizontally disposed grate. In this manner, the sink stopper can be removed from the insert assembly, if desired; however, it is quite difficult to do so as one's fingers must reach below the plug of the sink stopper and very firmly press on the two stem portions. This action is very difficult to perform as there is very little room to get one's fingers under the plug. Further, the two shoulders are of a significant size, perhaps ⅛ inch to ¼ inch each. Accordingly, the two stem portions must be pressed together by a distance of about ¼ to ½ inch, which is exceedingly difficult. This sink stopper is not meant to be removed from the insert assembly of the sink on a routine basis, but can be removed if absolutely necessary.

United Kingdom patent No. 1,031,993 to RYAN also discloses a sink stopper with a plug mounted on a two leg wire clip. The two legs of the wire clip are each shaped such that the clip has an upper narrow portion, a middle wider portion, and a lower narrow portion, and outwardly extending hooks at the bottom. In use, the spring clip resides in the central guiding aperture in the grate of the insert assembly of a sink. When the plug is in a seated flow precluding position, the upper narrow portion of the spring clip engages the grate. When the sink stopper is in its raised flow permitting position, the wide portion of the spring clip rests on the grate to preclude the sink stopper from returning to its seated flow precluding position, unless purposely pushed there. The hook portions preclude the sink stopper from being removed from the insert assembly by merely lifting the sink stopper upwardly. In order to remove the sink stopper, it is necessary that the legs of the spring clip be pinched together in order to permit the two hook portions to simultaneously fit through the central guiding aperture in the grate, which pinching is quite difficult as there is very little room to get one's fingers under the plug. In an alternative embodiment, the sink stopper is made from vulcanite or a similar substance and has a head secured to the stopper portion with a pair of legs depending from the head. The legs bend resiliently towards each other to permit passage of feet on the ends thereof through the central guiding aperture in the grate of the insert assembly. The top portion of the foot of each leg has a shoulder portion disposed at the top thereof, which shoulder portions are generally horizontally disposed where they meet the respective leg. Accordingly, each shoulder portion abuts directly against the grate, thus precluding upward movement of the grate. Again, in order to remove the sink stopper, it is necessary to use one's fingers to pinch the legs, which pinching is quite difficult. This sink stopper is not meant to be removed from the insert assembly of the sink on a routine basis, but can be removed if absolutely necessary.

SUMMARY OF THE INVENTION

In accordance with one aspect of the present invention, there is provided a sink stopper for use with an insert assembly in a sink, the insert assembly having a grate with a plurality of drainage apertures and a central guiding aperture therein. The sink stopper comprises a perforated strainer basket having a substantially planar bottom portion, and a sealing member disposed on the strainer basket shaped and dimensioned to engage the insert assembly in substantially water-tight sealed relation. A handle extends upwardly from the strainer basket for manually manipulating the sink stopper. A generally centrally disposed locating stem depends downwardly from the bottom portion of the strainer basket, and is shaped and dimensioned for insertion into the central guiding aperture. The generally centrally disposed locating stem comprises a base portion located adjacent the bottom portion of the strainer basket, two substantially parallel spaced-apart co-operating legs extending downwardly from the base portion, each of the legs having a top end, a bottom end, and a peripheral surface for contacting the grate of the insert assembly at the circumference of the central guiding aperture. The legs are substantially rigid yet resiliently deformable towards each other when the legs are subjected to inwardly directed lateral pinching reaction forces from the grate, at a time when the locating stem is pushed downwardly through the central guiding aperture in the grate. Each peripheral surface comprises an outwardly and upwardly sloped guide surface disposed at the bottom end portion thereof an outwardly and downwardly sloped grate-contacting surface disposed at the top end portion thereof, and a grate-receiving notch disposed between the guide surface and the grate-contacting surface. The grate-receiving notch includes an upwardly facing catch surface shaped and dimensioned to catch on the grate in interfering relation therewith. The maximum width of the locating stem at the bottom end of the sloped grate-contacting surface is greater than the diameter of the central guiding aperture in the grate. The sink stopper is movable between a seated flow precluding position whereat the locating stem engages the grate at the outwardly and downwardly sloped grate-contacting surface so as to thereby bias the sink stopper downwardly, and a raised straining position whereat the locating stem engages the grate at the grate-receiving notch, so as to thereby support the sink stopper and so as to resist upward movement therefrom of the sink stopper.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
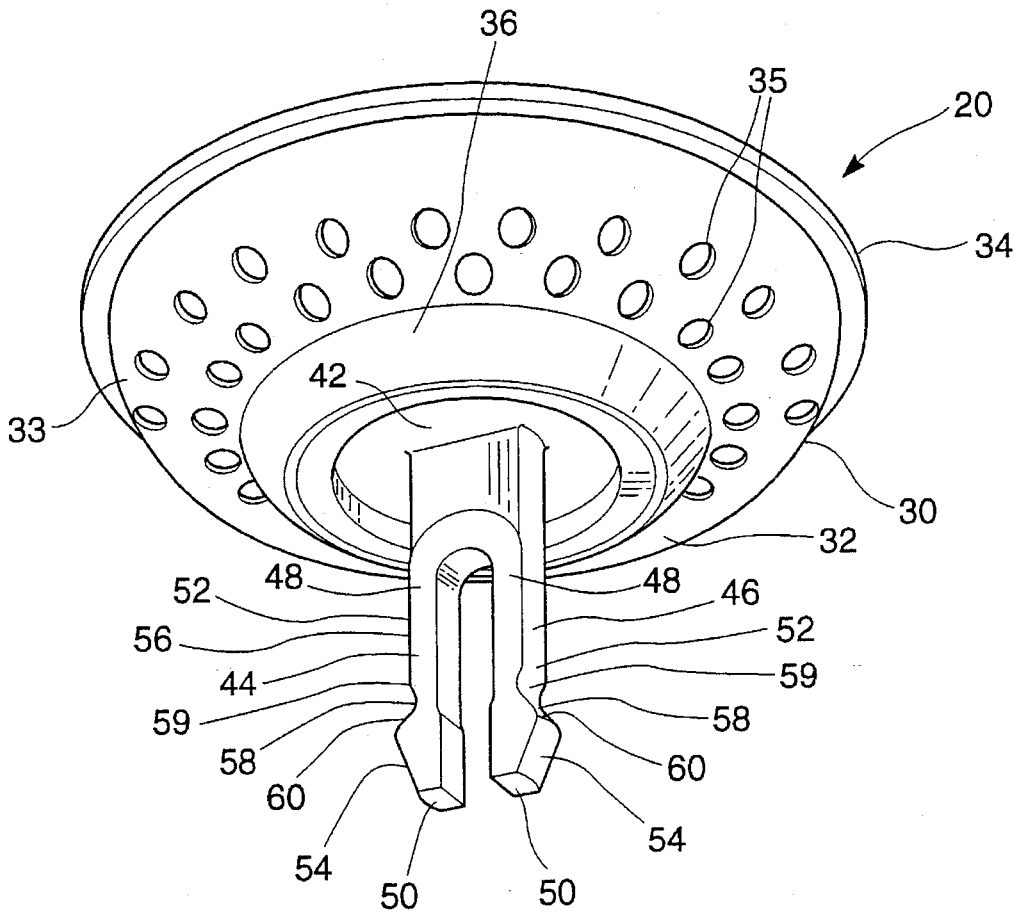
FIG. 1 is a perspective view from the bottom of the preferred embodiment of the sink stopper of the present invention.

Reference will now be made to FIGS. 1 through 7, which show the preferred embodiment of the present invention, namely a sink stopper 20 for use within a conventional insert assembly 24 in a sink 22, such as a kitchen sink. The insert assembly 24 has a grate 25 with a plurality of drainage apertures (not shown), and a central guiding aperture 28 therein.

The sink stopper 20 comprises a perforated strainer basket 30 having a substantially planar bottom portion 32, that curves upwardly to a wall portion 33 terminating in an outwardly turned lip portion 34. A sealing member 36 in the form of a conventional rubber gasket is disposed on the substantially planar bottom portion 32 of the strainer basket 30, and is shaped and dimensioned to engage a co-operating sloped shoulder portion 23 of the insert assembly 24 in the sink 22 in substantially water-tight sealed relation, so as to preclude the flow of water, and any debris therein, through the insert assembly 24 and into the drain (not shown) below. Perforations 35 are disposed in the bottom portion 32 above the sealing member 36 and also in the lower part of the wall portion 33. A generally centrally disposed handle 38 extends upwardly from the strainer basket 30 and permits manual manipulation of the sink stopper 20 both downwardly into the insert assembly 24 and upwardly from the insert assembly 24.

A generally centrally disposed locating stem 40 depends downwardly from the bottom portion 32 of the strainer basket 30, and has its top portion surrounded by the sealing member 36. In the preferred embodiment, the locating stem is a unitary structure made from a plastic material such as NYLON™ or DELRIN™ 100. The generally centrally disposed locating stem 40 is shaped and dimensioned for insertion into the central guiding aperture 28 of the grate 25, and comprises a base portion 42 located adjacent the bottom portion 32 of the strainer basket 30, and two substantially parallel spaced apart co-operating legs 44, 46 extending downwardly from the base portion 32 of the strainer basket 30. The legs 44, 46 are mirror images one of the other and, accordingly, have corresponding similar parts, which similar parts of the two legs 44, 46 will be indicated by like reference numerals, for the sake of clarity. Each of the legs 44, 46 has a top end 48, a bottom end 50, and a peripheral surface 52. The peripheral surface of each of the legs 44, 46 is for contacting the grate 25 of the insert assembly 24 at the circumference of the central guiding aperture 28.

The legs 44, 46 are rigid and yet resiliently deformable towards each other, when the legs 44, 46 are subjected to inwardly directed lateral pinching reaction forces from the grate 25. Such inwardly directed lateral pinching reaction forces occur at a time when the sink stopper 20 is being inserted into the insert assembly 24 of a sink 22, such that the locating stem 40 is being pushed downwardly through the central guiding aperture 28 in the grate 25.

Each of the peripheral surfaces 52 comprises an outwardly and upwardly sloped guide surface 54, which is preferably sloped at an angle of about 20° with respect to vertical, but may be sloped at any suitable angle to permit the legs 44, 46 of the locating stem 40 to be pinched together by the grate 25 when initially inserted through the central guiding aperture 28. The overall width "$W_1$", at the bottom end 50 of each of the legs 44, 46 of the locating stem 40 must be less than the diameter of the central guiding aperture 28 in order to permit the ready insertion of the bottom end portion 41 of the locating stem 40 into the central guiding aperture 28.

An outwardly and downwardly sloped grate contacting surface 56 is disposed at the top end portion of each of the peripheral surface 52. In the preferred embodiment, the grate contacting surfaces 56 are sloped at an angle of about 5° with respect to vertical, but may also be sloped at any other suitable angle between about 1° and about 10°. The purpose of the grate contacting surfaces 56 will be discussed subsequently.

A grate receiving notch 58 is disposed between the sloped guide surface 54 and the sloped grate contacting surface 56. The grate receiving notch 58 includes a downwardly facing support surface 59 and an upwardly facing catch surface 60 shaped and dimensioned to catch on the grate 25 in interfering relation therewith, when the sink stopper 20 is disposed within the insert assembly 24 such thin the grate 25 is received in the grate receiving notch 58 and the sink stopper 20 is being lifted upwardly. In the preferred embodiment, the catch surfaces 60 are sloped at an angle of about 45° with respect to horizontal in order to permit inwardly directed lateral pinching reaction forces to be applied to the grate 25 when the sink stopper 20 is lifted from the insert assembly 24, thus causing the two legs 44, 46 to be pinched together until the maximum width of the legs at the bottom of the catch surfaces 60 is essentially the same as the diameter of the central guiding aperture 28 in the grate 25.

Figure 5:
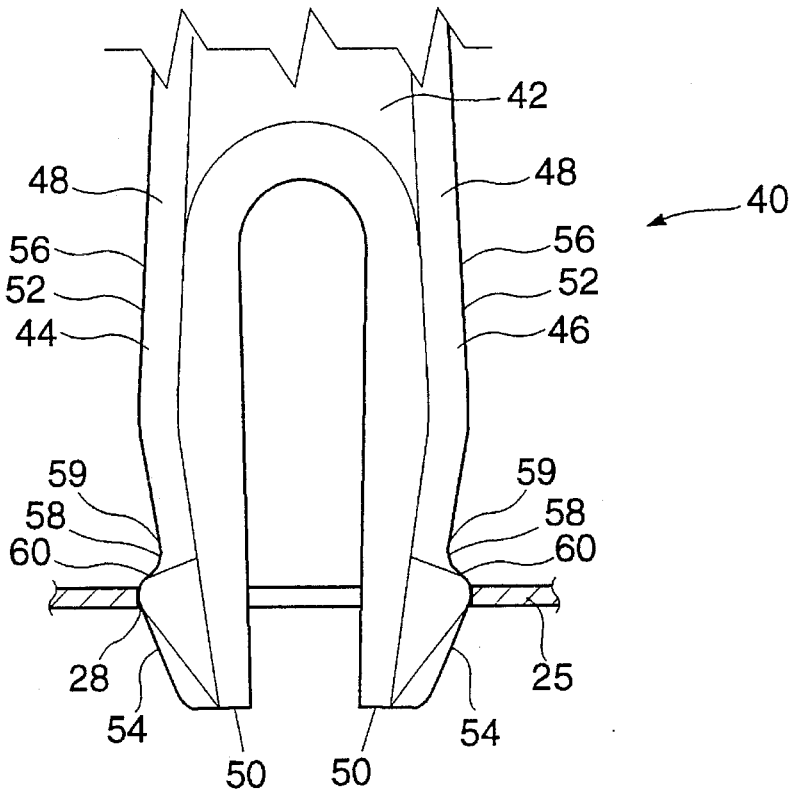
FIG. 5 is an enlarged partially cut-away side elevational view similar to FIG. 3, with the legs of the sink stopper partially entered to a point of maximum compression together of the two legs.
Figure 7:
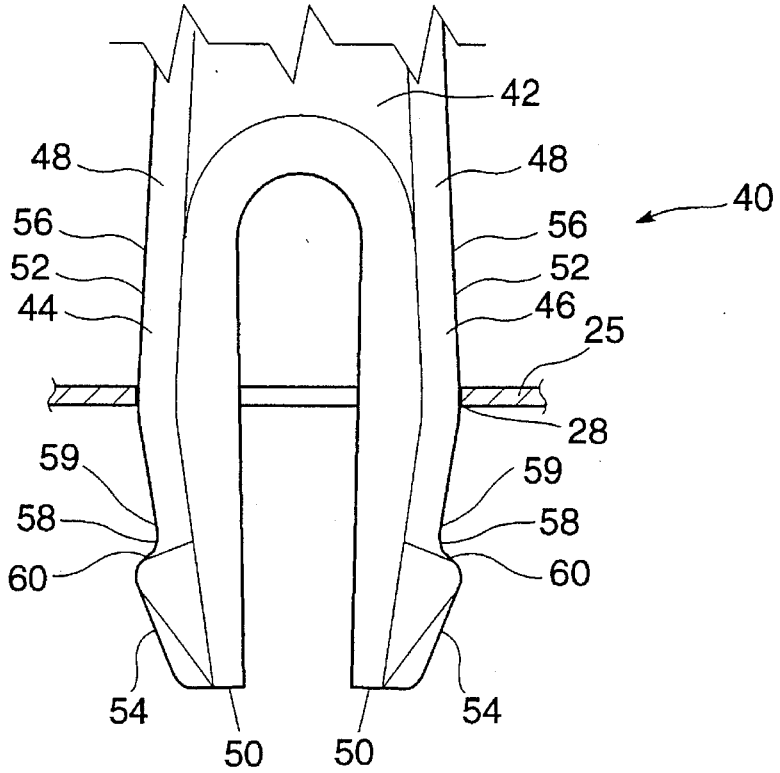
FIG. 7 is an enlarged partially cut-away side elevational view similar to FIG. 3, with the sink stopper being pushed down to just below its raised straining position and moving towards its seated flow precluding position.

The sink stopper 20 is moveable between a seated flow precluding position, as can best be seen in FIG. 7, and a raised straining position, as is best seen in FIG. 5. In the seated flow precluding position, the locating stem 40 engages the grate 25 at its outwardly and downwardly sloped grate contacting surface 56. The maximum width "$W_2$" of the locating stem 40 at the bottom portion of the sloped grate contacting surface 56 is greater than the diameter of the central guiding aperture 28 in the grate, when the legs 44, 46 are in their neutral rest position. In this manner, when the sink stopper 20 is in its seated flow precluding position, the two legs 44, 46 are biased inwardly by the grate 25. Further, the outward and downward slope of the sloped grate contacting surfaces 56 provide for a slight downwardly directed biasing force, which biasing force resists the upward movement of the sink stopper 20 when going from its seated flow precluding position to its raised straining position. The downwardly direct biasing force also biases the sink stopper 20 downwardly, thereby keeping the sink stopper 20 securely in place, and precludes the sink stopper 20 from unwantedly lifting from its seated flow precluding position to its raised straining position. In its raised straining position, the locating stem 40 engages the grate 25 at its grate receiving notch 58, with the downwardly facing support surface 59 of the grate receiving notch 58 resting on the grate 25, so as to thereby support the sink stopper 20. The width of the locating stem 40 at the grate receiving notch 58 is approximately equal to, or slightly greater than, the diameter of the central guiding aperture 28 in the grate 25. Further, in this raised straining position, the upwardly facing catch surface 60 of the grate receiving notch 58 is immediately below the grate 25, so as to resist upward movement from that position of the sink stopper 20, in the event that the sink stopper 20 is pulled upwardly.

Figure 2:
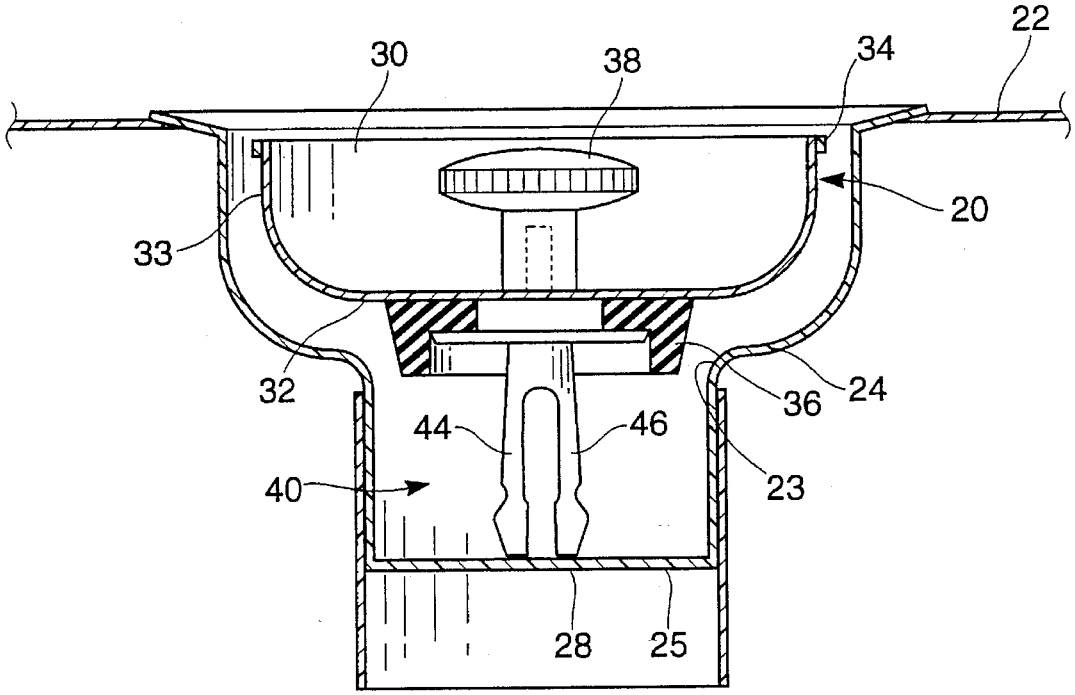
FIG. 2 is a partially cut-away side elevational view of the sink stopper of FIG. 1, with the sink stopper disposed above the insert assembly and grate and with the legs of the sink stopper about to enter the central guiding aperture of the grate.
Figure 3:
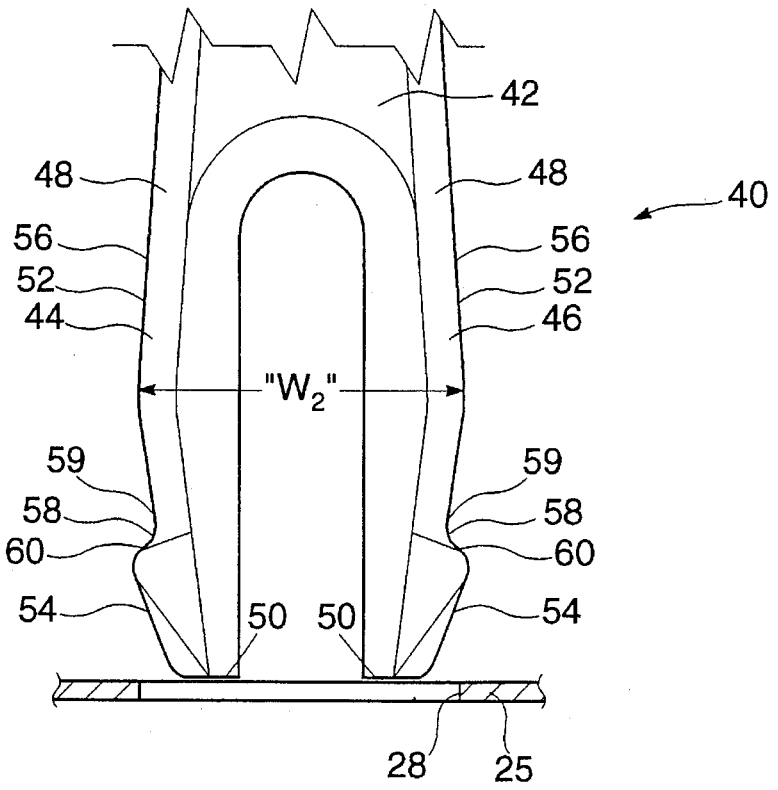
FIG. 3 is an enlarged partially cut-away side elevational view of a portion of the sink stopper of FIG. 2, with the legs of the sink stopper about to enter the central guiding aperture of the grate.
Figure 4:
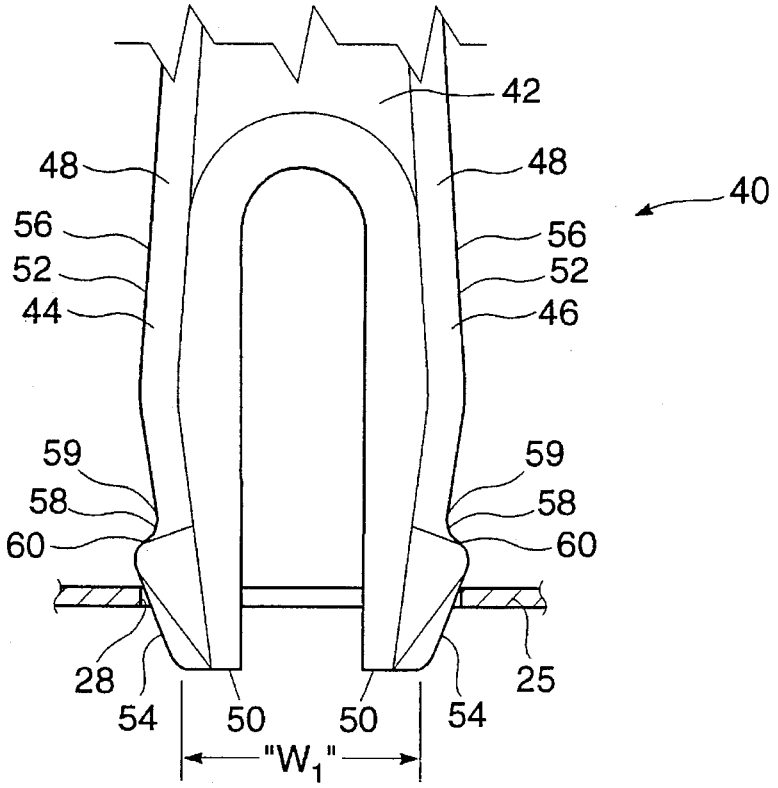
FIG. 4 is an enlarged partially cut-away side elevational view similar to FIG. 3, with the legs of the sink stopper partially entered into the central guiding aperture of the grate and slightly compressed together by the grate.
Figure 6:
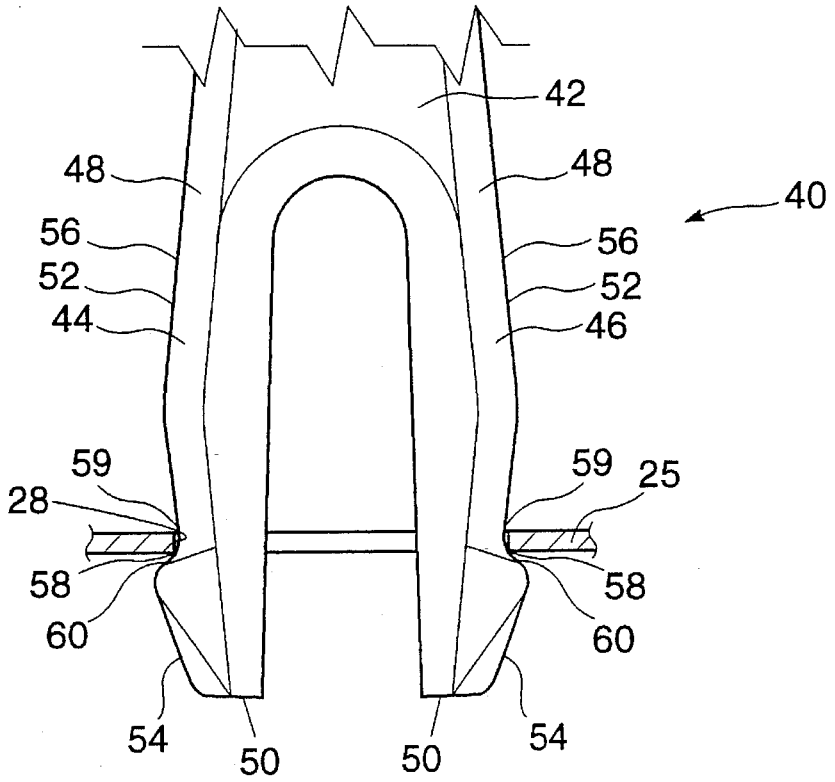
FIG. 6 is an enlarged partially cut-away side elevational view similar to FIG. 3, with the sink stopper in its raised straining position whereat the locating stem engages the grate at the grate receiving notch.

In use, the sink stopper 20 is initially inserted into the mouth of the insert assembly 24, as shown in FIGS. 2 and 3. The extreme end of the locating stem 40 enters the central guiding aperture 28 of the grate 25, as is shown in FIG. 4. As can be seen in FIG. 3, when the legs 44, 46 of the locating stem 40 are initially pushed into the central guiding aperture 28, the legs 44, 46 deform inwardly towards each other. Such inward deformation is caused by the inwardly directed lateral pinching reaction forces from the grate 25 acting on the outwardly and upwardly sloped guide surfaces 54 of the legs 44, 46. As can be seen in FIG. 5, the two legs 44, 46 are pinched together maximally when the portion of the peripheral surface 52 at the bottom portion of the notch 58 and the top portion of the outwardly and upwardly sloped guide surface 54—in other words, the maximum width of the locating stem 40—is at the grate 25. Immediately thereafter, the sink stopper 20 moves downwardly such that the locating stem 40 engages the grate 25 at grate receiving notches 58, as can be seen in FIG. 6, which corresponds to the raised straining position of the sink stopper 20. The sink stopper 20 is precluded from readily falling downwardly from this its raised straining position by the support surface 59 of the grate receiving notch 58. The sink stopper 20 is precluded from being pulled upwardly out of its raised straining position, and therefore subsequently removed from the insert assembly 24, except by a reasonably substantial force, by means of the upwardly facing catch surface 60. In this manner, it is difficult to unwantedly fully remove the sink stopper 20 from the insert assembly 24, but it is not overly difficult to do so, if desired.

Figure 8:
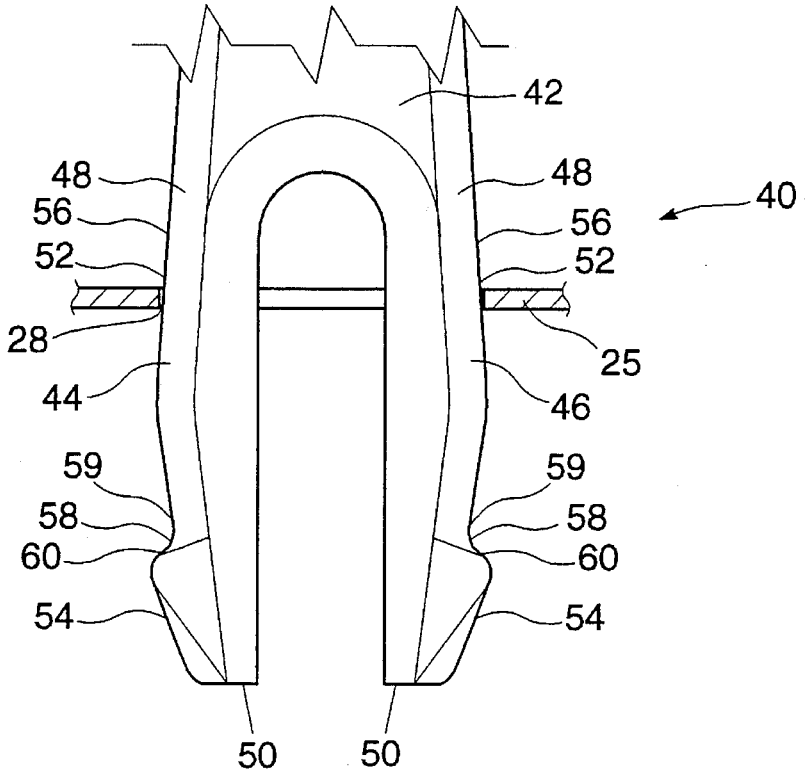
FIG. 8 is an enlarged partially cut-away side elevational view similar to FIG. 3, with the sink stopper in its seated flow precluding position.

If the sink stopper 20 is then pushed further downwardly from its raised straining position, the two legs 44, 46 are then pinched together again by virtue of the increased width of the locating stem 40 at the curved vertex between the grate receiving notch 58 and the sloped grate contacting surface 56, as is best seen in FIG. 7. The sink stopper 20 may pushed downwardly until it reaches it seated flow precluding position, whereat the sealing member 36 engages the insert assembly 24 in substantially water-tight sealed relation. In this position, the sloped grate contacting surfaces 56 of the legs 44, 46 of the locating stem 40 engage the grate 25. The outward and downward slope of the sloped grate contacting surfaces 56 cause the sink stopper 20 to be biased downwardly, thereby retaining the sink stopper in its seated flow precluding position, as can be seen in FIG. 8.

Other modifications and alterations may be used in the design and manufacture of the apparatus of the present invention without departing from the spirit and scope of the accompanying claims.

What is claimed is:

1. A sink stopper for use with an insert assembly in a sink, said insert assembly having a grate with a plurality of drainage apertures and a central guiding aperture therein, said sink stopper comprising:

a perforated strainer basket having a substantially planar bottom portion;

a sealing member disposed on said strainer basket and shaped and dimensioned to engage said insert assembly in substantially water-tight sealed relation;

a handle extending upwardly from said strainer basket for manually manipulating said sink stopper; and a generally centrally disposed locating stem depending downwardly from said bottom portion of said strainer basket, and being shaped and dimensioned for insertion into said central guiding aperture;

wherein said generally centrally disposed locating stem comprises a base portion located adjacent said bottom portion of said strainer basket, two substantially parallel and coplanar spaced-apart co-operating legs extending downwardly from said base portion, each of said legs having a top end, a bottom end, and a peripheral surface for contacting said grate of said insert assembly at the circumference of said central guiding aperture;

wherein said legs are substantially rigid yet resiliently deformable within the same plane towards each other when said legs are subjected to inwardly directed lateral pinching reaction forces from said grate, at a time when said locating stem is pushed downwardly through said central guiding aperture in said grate;

wherein each said peripheral surface comprises an outwardly and upwardly sloped guide surface disposed at a bottom end portion thereof, an outwardly and downwardly sloped grate-contacting surface disposed at a top end portion thereof, and a grate-receiving notch disposed between said guide surface and said grate-contacting surface, wherein said grate-receiving notch includes an upwardly facing catch surface shaped and dimensioned to catch on said grate in interfering relation therewith;

wherein the maximum width of said locating stem at a bottom end of said sloped grate-contacting surface is adapted to be greater than the diameter of said central guiding aperture in said grate; and wherein said sink stopper is movable between a seated flow precluding position whereat said locating stem engages said grate at said outwardly and downwardly sloped grate-contacting surface so as to thereby bias said sink stopper downwardly, and a raised straining position whereat said locating stem engages said grate at said grate-receiving notch, so as to thereby support said sink stopper and so as to resist upward movement therefrom of said sink stopper.

2. The sink stopper of claim 1, wherein said stem is a unitary structure.

3. The sink stopper of claim 1, wherein said stem is made from plastic material.

4. The sink stopper of claim 1, wherein said outwardly and downwardly sloped grate contacting surfaces are sloped at an angle of about 5° with respect to a vertical axis of said stopper.

5. The sink stopper of claim 1, wherein said catch surfaces are sloped at an angle of about 45° with respect to a horizontal axis of said stopper.

6. The sink stopper of claim 1, wherein said outwardly and upwardly sloped guide surfaces are sloped at an angle of about 20° with respect to a vertical axis of said stopper.

7. The sink stopper of claim 1, wherein the width of said locating stem at said grate receiving notch is approximately equal to the diameter of said central guiding aperture in said grate.

* * * * *